US005188067A

United States Patent [19]

Fontichiaro et al.

[11] Patent Number: 5,188,067

[45] Date of Patent: Feb. 23, 1993

[54] ADJUSTABLE VALVE SYSTEM FOR AN INTERNAL COMBUSTION ENGINE

[75] Inventors: Dominic Fontichiaro, Dearborn Hts.; Daniel M. Kabat, Oxford, both of Mich.

[73] Assignee: Ford Motor Company, Dearborn, Mich.

[21] Appl. No.: 905,692

[22] Filed: Jun. 30, 1992

Related U.S. Application Data

[62] Division of Ser. No. 695,127, May 3, 1991, Pat. No. 5,159,906.

[51] Int. Cl.[5] ..... F01L 1/34; F01L 1/14

[52] U.S. Cl. ..... 123/90.18; 123/90.50

[58] Field of Search ..... 123/90.17, 90.18, 90.27, 123/90.48, 90.5

[56] References Cited

U.S. PATENT DOCUMENTS 3,915,129 10/1975 Rust et al. ..... 123/90.18
4,517,936 5/1985 Burgio di Aragona ..... 123/90.5
4,693,214 9/1987 Titolo ..... 123/90.18
4,850,311 7/1989 Sohn ..... 123/90.18

FOREIGN PATENT DOCUMENTS

87/06647 11/1987 PCT Int'l Appl. .
1109378 4/1968 United Kingdom .

*Primary Examiner*—E. Rollins Cross
*Assistant Examiner*—Weilun Lo
*Attorney, Agent, or Firm*—Jerome R. Drouillard; Roger L. May

[57] ABSTRACT

An adjustable valve system for an engine includes an axially shiftable camshaft with a plurality of cam lobes for actuating engine valves, with at least one of the lobes having a profile which varies as a function of the axial position of the lobe and camshaft. A bucket tappet includes a camshaft contact button which is mounted to a cradle and pivot pad such that the contact button and cradle will be allowed to pivot in response to axial shifting of the camshaft.

4 Claims, 3 Drawing Sheets

ADJUSTABLE VALVE SYSTEM FOR AN INTERNAL COMBUSTION ENGINE

This is a division of application Ser. No. 07/695,127, filed May 3, 1991, now U.S. Pat. No. 5,159,906.

BACKGROUND OF THE INVENTION

1. Field of the Invention

This invention relates to an adjustable valve system for an engine having an axially shiftable camshaft acting upon either valve lifters or rocker arms having pivoting rubbing block structures which accommodate changes in the cam lobe profile by pivoting about axes which are perpendicular to the axis of the camshaft, while being constrained by a spline and keyway structure from rotating about an axis parallel to the camshaft.

2. Disclosure Information

Internal combustion engine designers have considered the use of axially shifting camshafts for several years Such camshafts use lobes characterized by a profile which changes with the axial position of the lobe. Thus, by positioning the camshaft in a desired axial location, the valve lift, valve opening duration, and other operating characteristics of the cam may be set according to the requirements of the engine.

U.S. Pat. No. 4,517,936 to Burgio di Aragona, U.S. Pat. No. 4,570,581, U.S. Pat. No. 4,693,214, and U.S. Pat. No. 4,773,359, all Titolo, all disclose a tappet for use of axially displaceable camshafts. The tappet uses a flat shoe for contacting a cam, with the shoe riding in an elongate bearing saddle. This system is quite bulky and uses a multitude of parts. Further, the system of the '936 patent would appear to be inoperative because no structure is shown for preventing displacement of the shoe due to the lateral thrust imposed by the cam lobe upon the lifter. Although the later patents in the series to appear to solve this difficulty, they never let it suffer from the problem of being an extensive size and therefore of an undesirable nature for compact engine construction.

U.S. Pat. No. 3,915,129 to Rust et. al. discloses a cam follower having a ball with a flat surface for engaging the cam surface. This design does suffer from the disability that if the ball should leave the surface of the cam lobe, and such is frequently the case during high speed operation of an engine, the ball may very well rotate so that the flat spot is no longer in contact with the camshaft lobe. If such were to occur, rapid wear would quickly destroy the camshaft and the cam follower.

U.S Pat. No. 1,500,556 to Goodwin discloses a cam follower having a rocker which is pinned to the cam follower and is not suitable for use in following a contoured axially shiftable camshaft.

U.S. Pat. No. 4,393,820 to Maki et. al. and U.S. Pat. No. 4,850,311 to General Motors disclose a cardanic rocker arm and lifter assembly, respectively. These devices use non-rubbing type rotation to accommodate the relative movement needed between a rocker arm and mounting fulcrum and bucket type tappet, respectively Neither of these patents disclose the anti-rotation features of a valve system according to the present invention.

It is an advantage of a system according to the present invention that a valve lifter made according to this invention will be physically compact and suitable for use with camshaft rubbing blocks which may be either flat or arcuate or which may include a roller assembly It is yet another advantage of the present invention that an adjustable valve system according to this invention may accommodate the use of camshafts having more aggressive profiles than the camshafts suited for use with known axially adjustable cam follower assemblies.

Other objects, features and advantages of the Present invention will become apparent to the reader of the specification.

SUMMARY OF THE INVENTION

An adjustable valve system for an engine includes an axially shiftable camshaft having a plurality of cam lobes for actuating engine valves, with at least one of the lobes having a profile which varies as a function of the axial position of the lobe. The system further includes at least one valve lifter which is displaceable by an axially variable cam lobe. The lifter includes a generally cylindrical body adapted to be slidably received in a bore within an engine, with the lifter having a concave arcuate surface at one end. The concave arcuate surface has a keyway formed therein in the direction parallel to the axis of the camshaft. The lifter further includes a camshaft rubbing block which is pivotably mounted to the lifter body and which has a convex arcuate surface in contact with the concave surface. The rubbing block has a spline projecting into the keyway formed in the mating concave surface so that the rubbing block may accommodate changes in cam lobe Profile by pivoting about an imaginary axis which is perpendicular to the axis of the camshaft, while being constrained by the spline and keyway from rotating about an axis which is parallel to the camshaft.

Alternatively, the rubbing block may further comprise an elongate projection having a flat or convex cam lobe rubbing surface for contacting the camshaft, or a roller which contacts the camshaft wherein the axle of the roller is mounted within the rubbing block in a direction parallel to the axis of the camshaft. The rubbing block itself preferably comprises a hemispherical body with the convex surface forming the base of the hemisphere. The rubbing block is preferably retained to lifter body by means of an apertured sleeve projecting from the lifter body. The lifter further comprises means for preventing the lifter from rotating about its center axis. If desired, the lifter may be equipped with hydraulic lash adjusting means for setting operating clearances within the valve system.

Another aspect of the present invention is related to an axially shiftable overhead mounted camshaft type of valve system in which the camshaft actuates finger followers. In this case, the finger followers generally comprise an elongate body having a first end pivotably mounted to a pedestal carried by the cylinder head of the engine and a second end bearing upon the tip of the valve stem. The finger follower further includes a roller assembly pivotably mounted to the elongate body in a position intermediate the first and second ends, with the axle of the roller being generally parallel to the axis of the camshaft and located such that the axially variable cam lobe may bear upon the roller. The pivotable mounting of the roller allows the roller assembly to pivot about an imaginary axis which is perpendicular to the axis of the camshaft, while being constrained from rotating about an axis parallel to the camshaft. The pivotable mount includes a concave arcuate surface defined in the upper surface of the roller follower body and a roller mounting block having a convex arcuate surface in contact with the concave surface and a follower body and a roller mounting block having a convex arcuate surface in contact with the concave surface and a tang projecting into an aperture formed in the concave surface such that the rubbing block will be allowed limited rotational movement about an imaginary axis described before which is perpendicular to the axis of the camshaft, while being constrained from rotating about either an axis parallel to the camshaft or about the center axis of the mounting block itself.

DETAILED DESCRIPTION OF THE PREFERRED EMBODIMENTS

Figure 3:
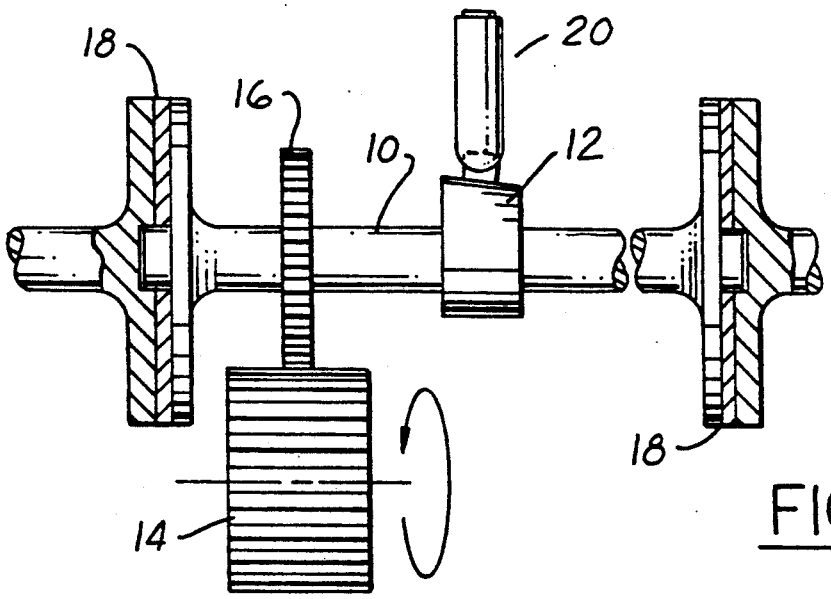
FIG. 3 is a schematic representation of an adjustable valve system according to the present invention.

As shown in FIG. 3, an adjustable valve system according to the present invention is intended to be driven by a gear or some other means known to those skilled in the art and suggested by this disclosure from the crankshaft of the engine. Accordingly, gear 14 of FIG. 3 is intended to represent that camshaft 10 is driven by the crankshaft of the engine. Driven gear 16 which is individually attached to the camshaft receives the power from the crank-driven gear. Camshaft 10 is situated between a pair of thrust bearings 18, which accommodate axial shifting of the camshaft. The camshaft is depicted as having a single cam lobe 12, it being understood that an engine would normally have a plurality of such cam lobes attached to the camshaft. Cam lobe 12 displaces valve lifter 20 when the camshaft rotates because the profile of cam lobe 12 changes with its angular position. Of equal importance is the fact that the profile of cam lobe 12 changes with its axial position with respect to lifter 20. Accordingly, the timing and lift profile of the valve events being controlled by cam lobe 12 can be altered by repositioning camshaft 16 axially with respect to lifter 20. Those skilled in the art will appreciate in view of this disclosure that a system according to this invention could be combined with other types of phase shifting mechanisms, such as those which alter the phase angle at which the camshaft is being driven with respect to the crankshaft.

Figure 1:
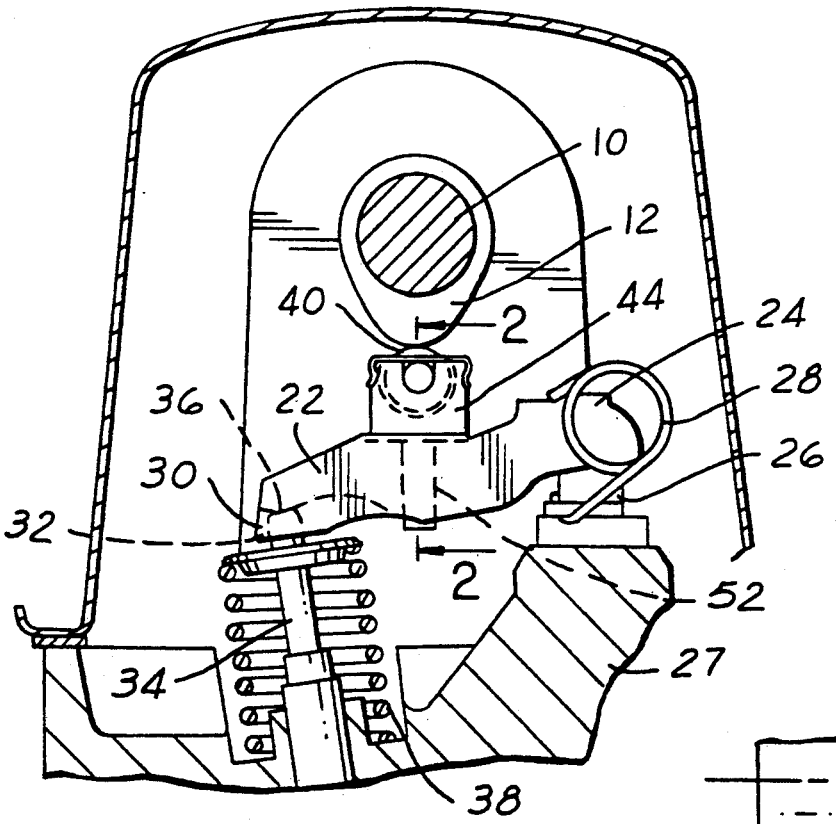
FIG. 1 is an end view of an engine cylinder head having an adjustable valve system according to the present invention with a roller finger follower interposed between the camshaft and valve stem.
Figure 2:
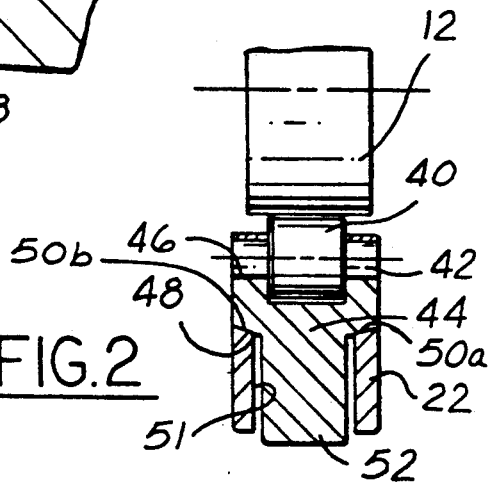
FIG. 2 is a sectional view, partially broken away, of the roller finger follower and camshaft of FIG. 1 taken along the line 2—2 of FIG. 1.

FIGS. 1 and 2 illustrate a first embodiment of an adjustable valve system according to the present invention. FIG. 1 illustrates an engine having an overhead camshaft 10 with one or more cam lobes 12 rigidly fixed thereto. Each cam lobe 12 bears upon a roller 40, which is journaled to a finger follower by means of axle 42 (FIG. 2). Axle 42 is received within axle bore 46 within roller mounting block 44. The roller mounting block includes a convex arcuate surface 48, which allows the roller mounting block to slide upon a complementary concave mounting surface 51*a* and 50*b*, which is formed in the upper part of the elongate body 22 of the follower. As shown in FIGS. 1 and 2, roller mounting block 44 has a tang 52, which projects downwardly into aperture 51 formed within the follower body 22. The tang allows roller mounting block 44 and roller 40 to have limited rotational movement about an imaginary axis which is perpendicular to the axis of camshaft 10, while being constrained from rotating about either an axis parallel to the axis of the camshaft or about the center axis of the mounting block itself The center axis of the mounting block is roughly defined along the line 2—2 of FIG. 1.

The finger follower of FIG. 1 has a first end 24 which is pivotably mounted to Pedestal 26, which is carried upon cylinder head 27. The pedestal may comprise a ball stud including an automatic lash adjuster or other type of finger follower mounting known to those skilled in the art and suggested by this disclosure. The follower is maintained in contact with cam lobe 12 by means of torsion spring 28. The second end 30 of the follower has a valve pocket 32 which fits about a tip 36 of valve stem 34. Valve spring 38 biases the valve into a closed position. Because tip 36 is pocketed into valve pocket 32, elongate body 22 will be Prevented from rotating in response to force exerted upon roller 40 in a direction parallel to camshaft 10. Axial movement of camshaft 10 will, however, be accommodated by the sliding rotation of roller mounting block 44 with respect to body 22 along convex arcuate surface 48 and concave arcuate surface 50*a*, 50*b*. It should be understood that the broken only by aperture 51.

Figure 4:
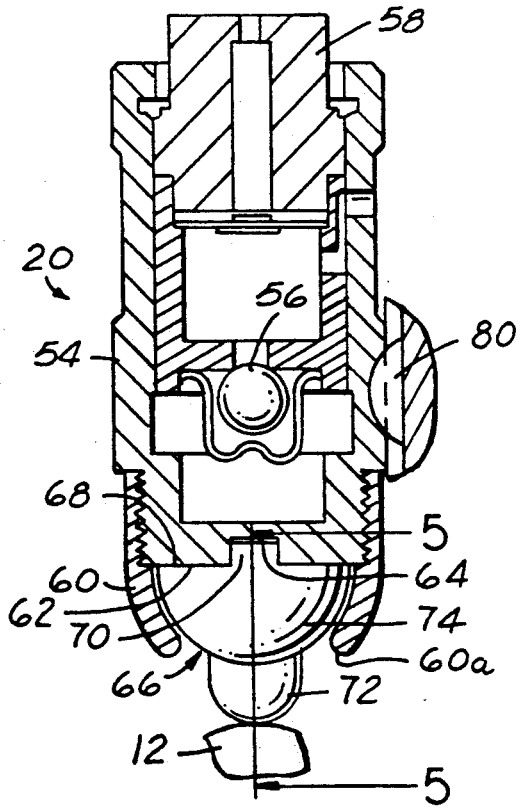
FIG. 4 is a sectional view of one embodiment of a valve lifter according to the present invention.
Figure 6:
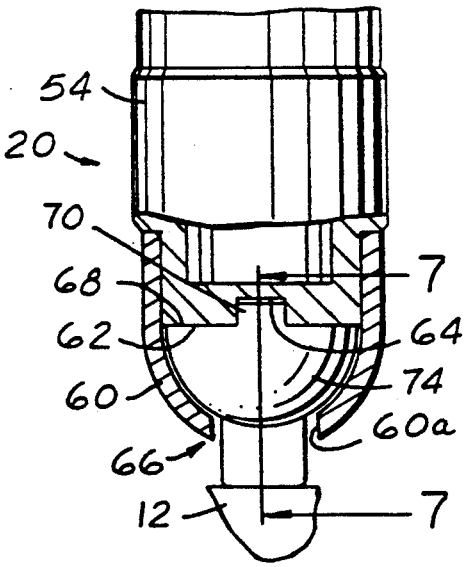
FIG. 6 is a sectional view, partially broken away, of a second embodiment of a valve lifter according to the present invention.
Figure 7:
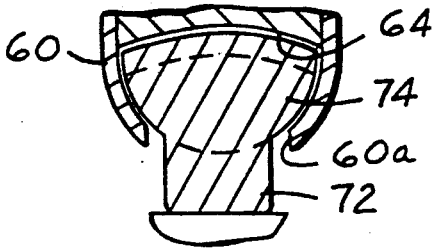
FIG. 7 is a sectional view, partially broken away, of the lifter of FIG. 6, taken along the line 7—7 of FIG. 6.
Figure 5:
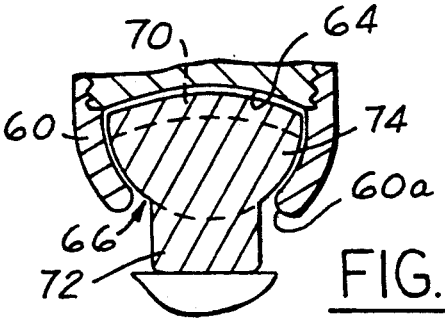
FIG. 5 is a sectional view of the valve lifter of FIG. 4, partially broken away, taken along the line 5—5 of FIG. 4.

FIGS. 4–7 illustrate a second embodiment according to the present invention. FIG. 4 contains a Partially schematic representation of a hydraulically adjustable valve lifter 20, having piston 58 and check ball 56 situated within cylindrical body 54 which is Prevented from rotating about its central axis by anti-rotation key 80, which is mated with a keyway slot formed longitudinally in the wall of a bore in which the lifter would be situated during operation. Those skilled in the art will appreciate that an adjustable valve system according to this invention could employ other types of lifters, including those which are not hydraulically adjustable for the purpose of establishing the length of the lifter and for setting the operating clearances within the valve system. In any event, a lifter according to the present invention will have a lower sleeve 60, which is either threadably (FIG. 4) or by means of an interference fit (FIG. 6) engaged with the lower portion of cylindrical body 54 of the lifter. Sleeve 60 has an aperture 60*a* at its lower extremity, which allows a portion of rubbing block 66 to project through the sleeve. Cylindrical body 54 has a concave arcuate surface, 62, formed in its lower end. This concave surface mates with a convex surface, 68, formed on the upper portion of hemispherical body 74. The concave and convex surfaces are sized so that hemispherical body 74 may slide so as to rotate about an imaginary axis, which is perpendicular to the axis of camshaft 10. Cylindrical body 54 has a keyway 64 which traverses concave surface 62. A mating spline 70 Projects upwardly from convex surface 68 of hemispherical body 74. Together, the spline and keyway prevent hemispherical body 74 from rotating about an axis parallel to camshaft 10. The lifter itself is restrained from rotating about its longitudinal axis by means of anti-rotation key 80 (FIG. 4). In the embodiment shown in FIGS. 4 and 5, the rubbing block, which is depicted as hemispherical body 74, is terminated at its lower extremity by elongate projection 72, which has a convex surface for contacting cam lobe 12. In the embodiment of FIGS. 6 and 7, rubbing block 74 is terminated by a flat projection, 72*a*. In both embodiments, spline 70 and keyway 64 maintain hemispherical body 74 and, hence, projection 72, in the proper orientation for contacting cam lobe 12.

Figure 9:
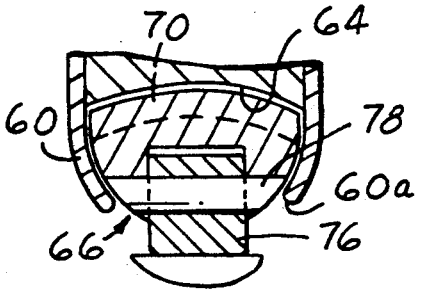
FIG. 9 is a sectional view taken along the line 9—9 of FIG. 8.
Figure 8:
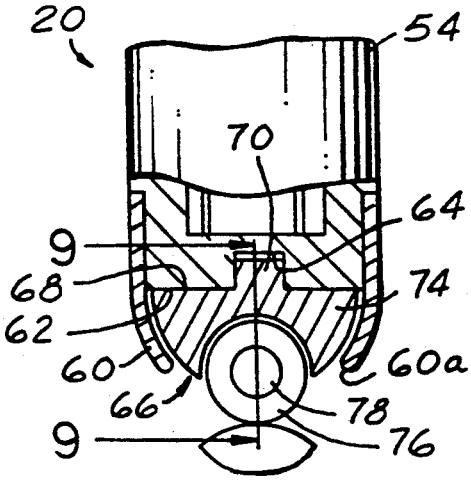
FIG. 8 is a partial section of a third embodiment of a valve lifter according to the present invention having a roller for engaging a camshaft lobe.

The second embodiment of a lifter according to the present invention is shown in FIGS. 8 and 9. As before, cylindrical body 54 has an apertured sleeve 60 located at the lower portion thereof.

Unlike the embodiment shown in FIGS. 4–7, the embodiment shown in FIGS. 8 and 9 includes a roller, 76, which is journaled to rubbing block by means of axle 78. In use, the axis of axle 78 would be parallel to the axis of camshaft 10. As before, spline 70 and keyway 64 would serve to prevent rotation of hemispherical body 74 about an axis parallel to camshaft 10, while allowing limited rotation about an imaginary axis which is Perpendicular to the axis of the camshaft and perpendicular to the central axis of the lifter. In this manner, the axial shifting of camshaft 10 may be accommodated.

Figure 11:
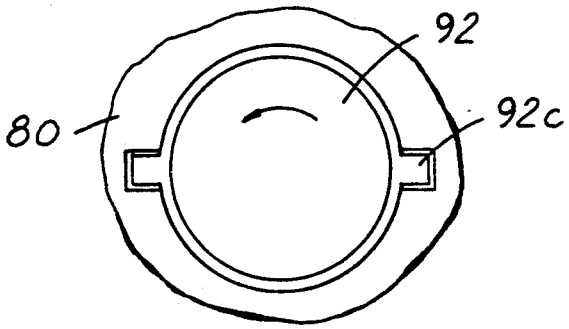
FIG. 11 is a plan view of the tappet arrangement illustrated in FIG. 10.
Figure 10:
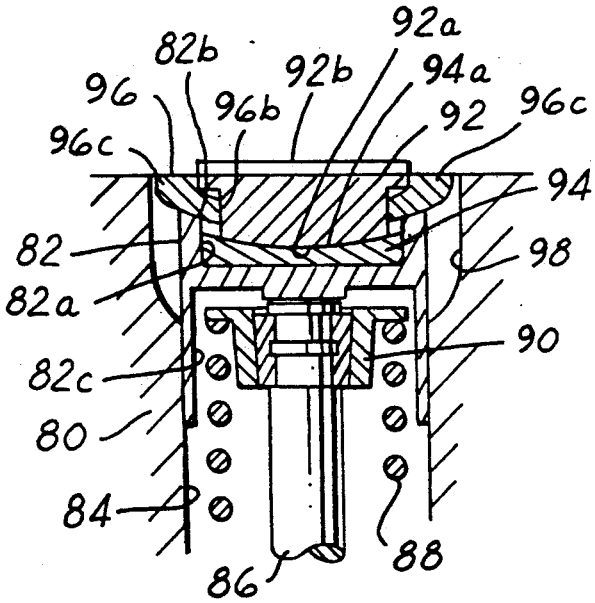
FIG. 10 is a sectional view of a third embodiment according to the present invention.

FIGS. 10 and 11 illustrate yet another embodiment according to the present invention. FIG. 10 illustrates a bucket tappet, 82, slidably received within a bore, 84, formed within the cylinder head, cylinder block or associated structure of an engine, 80. This bucket tappet is employable with the system shown schematically in FIG. 3.

As shown in FIG. 10, an engine valve having stem 86 is acted upon directly by tappet 82. The valve and valve spring 88 are maintained in the proper position by spring retainer 90. The body of the tappet is generally cylindrical in configuration and has a first longitudinal bore, 82*c*, for housing valve spring 88, retainer 90, and 94, which is surmounted by a rotating camshaft button, 92, mounted through aperture 96*b* formed in cradle 96. Button 92 and pivot pad 94 have mating arcuate surfaces, which in this case are illustrated as being concave on the pivot pad (94*a*) and convex on the camshaft contact button (92*a*). Those skilled in the art will appreciate in view of this disclosure that other arrangements of the various arcuate surfaces in this device are possible according to the present invention. Note that cradle 96 is slidably mounted to the end of the tappet's cylindrical body adjacent the bore housing pivot pad 94. Cradle 96 and annular surface, 82*b*, which is defined by bore 82*a* in the upper end of tappet 82, have mating arcuate surfaces, 96*a*, and 82*b*, respectively. Antirotation lugs 96*c* extending from cradle 96 cooperate with mating keyways 98 formed in cylinder block or head 80 to restrain cradle 96 from rotating in response to forces applied by the camshaft.

A tappet according to FIGS. 10 and 11 is advantageous because camshaft button 92, as well as the other parts of tappet 82 and valve stem 86 may be driven by camshaft lobe contact pressure to rotate about the center axis of the tappet (FIG. 11). This rotation will occur whenever the contact patch between the cam lobe and camshaft button is a sufficient distance from the centerline of the camshaft button so that the rotational force imposed upon the button exceeds the frictional forces otherwise preventing the tappet and valve from rotating.

The tappet of FIGS. 10 and 11 responds to axial shifting of the camshaft by realignment of camshaft contact surface 92*b* with the cam lobe. This realignment is caused by rotation of cradle 96 with respect to concave surface 82*b*, which is accompanied by simultaneous rotation of button 92 with respect to pivot pad 94. In the event that the engine is operating at the time the axial shift of the camshaft occurs, button 92 will simultaneously be rotated about an axis extending at an acute angle to the center axis of the tappet.

Figure 12:
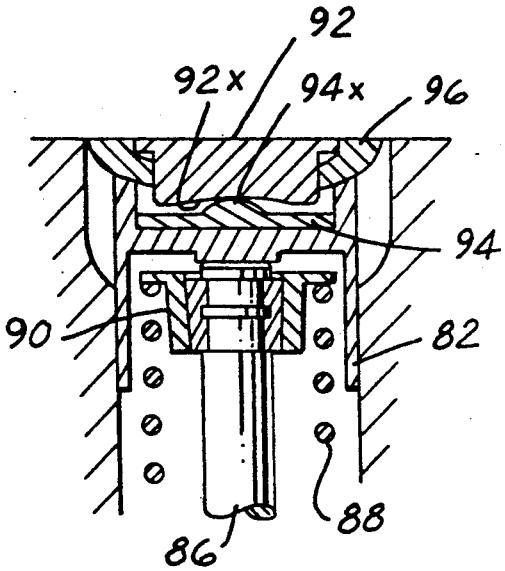
FIG. 12 is a sectional view of another embodiment according to the present invention, which embodiment is similar to that shown in FIGS. 10 and 11.

FIG. 12 illustrates another embodiment which is similar to the embodiment of FIGS. 10 and 11. Note however that the configuration of rotating wear button 92 is different insofar as the button has a large radius concave surface, 92*x*, formed in its lower extremity, which contacts pivot pad 94 in the area of a raised convex boss, 94*x*, extending from the surrounding surface of pivot pad 94.

While the invention has been shown and described in its preferred embodiments, it will be clear to those skilled in the arts to which they pertain that many changes and modifications may be made thereto without departing from the scope of the invention. For example, the illustrated systems could be employed equally well with tappets housed within either a cylinder head or engine block or an auxiliary housing provided specifically for the purpose of housing the tappets and camshaft.

We claim:

1. An adjustable valve system for an engine, comprising:

an axially shiftable camshaft having a plurality of cam lobes for actuating engine valves, with at least one of said lobes having a profile which varies as a function of the axial position of said lobe; and a bucket tappet displaceable by said axially variable cam lobe, with said tappet comprising:

a generally cylindrical body adapted to be slidably received in a bore within said engine, with said body having a first longitudinal bore for housing a valve spring, a valve spring retainer and valve stem;

a pivot pad housed within a second longitudinal bore formed in said cylindrical body and opposing the first longitudinal bore, with said pivot pad having arm arcuate bearing surface recessed within the second bore;

a cradle slidably mounted to the end of said cylindrical body adjacent the second bore and having an arcuate bearing surface in contact with a mating arcuate bearing surface formed in the annular surface defined by the second bore in the outer wall of the cylindrical body, with said cradle having an aperture extending therethrough; and a camshaft contact button mounted through said aperture and having a first end for contacting a lobe of the camshaft and a second end having a mating arcuate surface for contacting the arcuate surface of the pivot pad, whereby said contact button and said cradle will be allowed to pivot in response to the axial shifting of said camshaft.

2. An adjustable valve system according to claim 1, wherein said cradle further comprises at least one anti-rotation lug extending past the outer diameter of said cylindrical body into a keyway formed in the inner wall of the bore which houses the cylindrical body.

3. An adjustable valve system according to claim 1, wherein said arcuate bearing surface of said pivot pad has a concave shape and said arcuate bearing surface of said camshaft contact button has a convex shape.

4. An adjustable valve system according to claim 1, wherein said camshaft is shiftable to at least one position in which the action of the camshaft will cause the contact button to rotate about an axis extending at an acute angle to the center axis of the cylindrical body.

* * * * *